US007591762B2

(12) United States Patent
Chang

(10) Patent No.: US 7,591,762 B2
(45) Date of Patent: Sep. 22, 2009

(54) EXERCISE APPARATUS

(75) Inventor: Ziv Chang, Taya Hsiang (TW)

(73) Assignee: Johnson Health Tech Co., Ltd., Taichung Hsien (TW)

( * ) Notice: Subject to any disclaimer, the term of this patent is extended or adjusted under 35 U.S.C. 154(b) by 0 days.

(21) Appl. No.: 12/006,643

(22) Filed: Jan. 7, 2008

(65) Prior Publication Data

US 2009/0176624 A1 Jul. 9, 2009

(51) Int. Cl.
*A63B 22/04* (2006.01)

(52) U.S. Cl. ..... 482/52; 482/71; 482/80

(58) Field of Classification Search ..... 482/51, 482/52, 66, 70–71, 79–80, 110
See application file for complete search history.

(56) References Cited

U.S. PATENT DOCUMENTS 5,284,460 A * 2/1994 Miller et al. ..... 482/51
6,849,032 B2 * 2/2005 Chu ..... 482/51
6,918,861 B2 * 7/2005 Liao et al. ..... 482/57
7,338,414 B1 * 3/2008 Hsiung ..... 482/71
2005/0272562 A1 * 12/2005 Alessandri et al. ..... 482/52
2007/0027001 A1 * 2/2007 Alessandri et al. ..... 482/51
2007/0167289 A1 * 7/2007 Alessandri et al. ..... 482/51
2007/0225130 A1 * 9/2007 Maffei et al. ..... 482/71
2008/0132385 A1 * 6/2008 Alessandri et al. ..... 482/52
2008/0207400 A1 * 8/2008 Liao Lai ..... 482/1

* cited by examiner

*Primary Examiner*—Fenn C Mathew
*Assistant Examiner*—Andrew M Tecco

(57) ABSTRACT

An exercise machine comprises a frame, left and right swing mechanisms, left and right driving members, left and right actuating mechanisms, and a handle assembly. The left and right swing mechanisms are pivotally connected to the frame in outward skew modes. The left and right driving levers are respectively jointed between the left and right swing mechanisms and the left and right actuating mechanisms. Furthermore, one of the actuating mechanisms is coupled to a handle assembly which is connected to the frame in an inclined mode.

11 Claims, 8 Drawing Sheets

EXERCISE APPARATUS

BACKGROUND OF THE INVENTION

The present invention relates to an exercise apparatus, more particularly to an exercise apparatus which enables a user to train a wide range of muscles.

Present exercise apparatus are usually designed to imitate one type of human sport such as elliptical machines, stationary bicycles, treadmills or steppers to imitate running, riding bicycle or climbing. By using different training equipments, users can choose to train specific muscles. But, users use the exercise apparatus like those mentioned above may only train the general portion muscles of legs. If a user wants to fully exercise his legs, it is difficult to achieve by apparatus such as steppers or treadmills and so on. Besides, these exercise machines can't provide a user to exercise total body at the same time.

U.S. Pat. Pub. No. 2005/0272562 discloses an exercise machine simulating skating exercise. It may achieve the goal of making a user to fully exercise his muscles of legs. However, it still can't make people to exercise his upper body. And its left and right swing arms are independent. That may cause laypersons hard to use it. Furthermore, because such exercise machine adopts a pair of swing arms which are not identical and performs as a cross relationship, those factors may induce high production costs and make people hard to produce it.

And U.S. Pat. No. 6,918,861 discloses another machine for providing a user rotating exercise. A user may sit on the rotatable seat and support his feet on the foot support which is mounted to a rotatable lever. By this operation method, a user may push the foot support to drive the rotatable seat. Alternatively, a user may hold the hand grip to rotate it and drive the foot support to rotate. This invention may focus on exercising the waist of a user but still can't achieve total body training. And according to the structure of the machine, while a user stands on the foot support and holds the handle grip to do exercise, the user may loss balance because its foot support is in a declined mode. A user may also feel ache easily because the handle grip is extended vertically and the pedals are declined forward in a large angle, so it has to extend the upper body to hold the handle grip.

Clearly for the forgoing reasons, there is still a need for a machine that can inexpensively produce, corresponding kinesiology, and make a user to exercise a wide range of muscles of the user's body at the same time.

SUMMARY OF THE INVENTION

An exercise apparatus in accordance with the present invention comprises a frame adapted to rest on the floor surface, left and right swing mechanisms for supporting a user and providing him to do exercise. Each of the left and right swing mechanisms comprises a swing arm, a pedal, and a control member. In the front part of the exercise machine, there are left and right actuating mechanisms coupled to the frame. Left and right driving members respectively interconnected with the left and right swing mechanisms and left and right actuating mechanisms. A handle assembly has a handle member for a user to grip thereon and a rotating shaft interconnected with the frame and the handle member.

Each of the left and right swing arms has a supporting portion to engage with the respective pedals, and a pivoting portion pivoted to the frame in an outward skewed mode. The control members respectively interconnected to the frame and the pedals. The swing mechanisms can control the pedals to show as a declined forward mode when the swing mechanisms swing inward. When the swing mechanisms swing outward, the respective pedals will progressively rotate downward. And the front sections of the respective pedals progressively rotate outward when the left and right swing mechanisms are thrust outward. The left and right driving members are jointed between respective swing mechanisms and actuating mechanisms. By the left and right actuating mechanisms and driving members, the left and right swing mechanisms can be thrust to do swing motions interactively.

The handle assembly comprises a handle member and a rotating shaft interconnected with the frame and the handle member. Besides, one of the left and right actuating mechanisms further connected with the rotating shaft of the handle assembly, so that the handle assembly can be driven to rotate by the left and right swing mechanisms simultaneously. Therefore, the pivoting portions of the left and right swing mechanisms and the rotating shaft of the handle assembly rotate simultaneously when the actuating mechanisms is driven by the driving members.

The swing motions of the left and right swing mechanisms are in three dimensions because of the outward skewed pivoting portions. Furthermore, in a preferred embodiment, the exercise apparatus adapted two levers as driving members to conquer the variation on dimensions. So a user's lower body and upper body will experience exercise simultaneously, and the swing motions of the swing mechanisms also train the user's legs as a total, fully exercise type.

In one embodiment, an exercise apparatus has substantially the same structure. And it further has a specific characteristic of making the pivoting portion of the swing mechanism and the rotating shaft of the handle assembly "rotate at a same direction" when the actuating mechanism is driven by the driving member. Therefore, the embodiment can make a user's body experiences huddling up, extending, and rotation exercise that various exercise types further enhance the training intensity.

These and other features, aspects, and advantages of the present invention will become better understood with reference to the following description and claims.

BRIEF DESCRIPTION OF THE DRAWINGS

These and other features, aspects, and advantages of the present invention will become better understood with regard to the following description, appended claims, and accompanying drawings:

DETAIL DESCRIPTION

Figure 1:
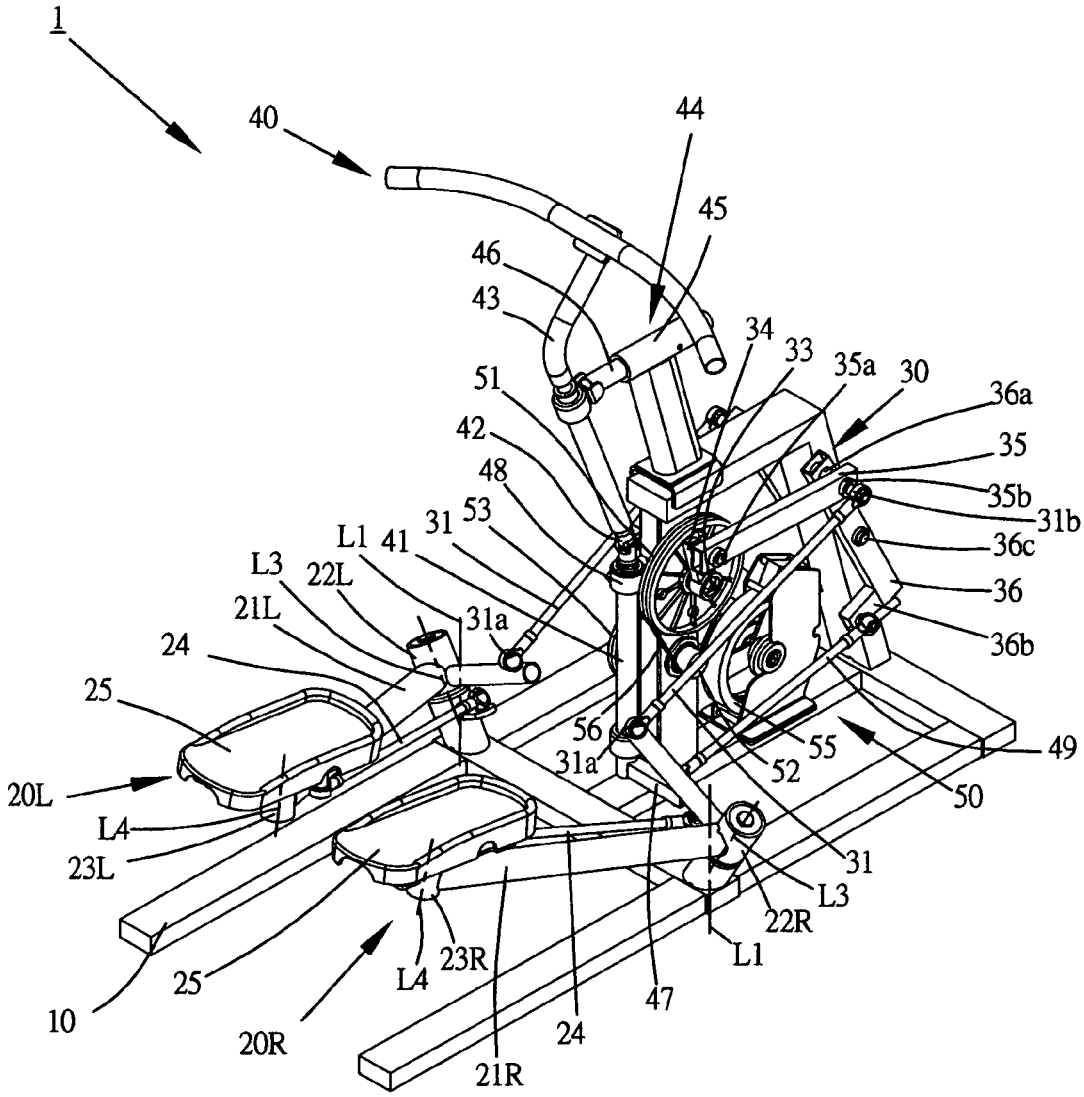
FIG. 1 is a perspective view of an exercise apparatus according to a preferred embodiment of the present invention.
Figure 2:
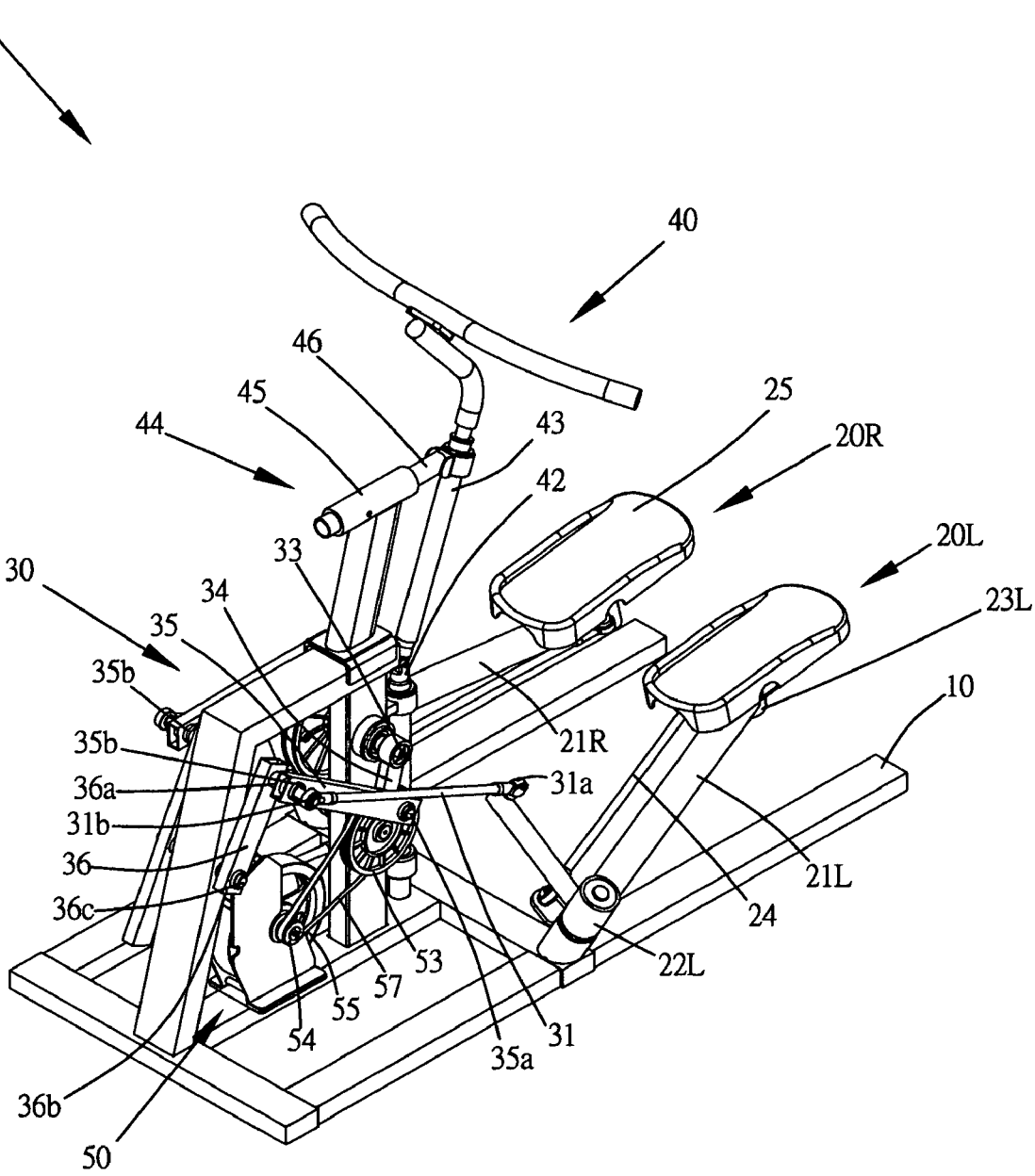
FIG. 2 is an another perspective view of the exercise apparatus shown the structure of the preferred embodiment which is not shown in FIG. 1.

FIG. 1 and FIG. 2 illustrate an embodiment of an exercise apparatus 1 having a frame 10 adapted to rest on the floor surface and providing a foundation for other mechanisms to couple thereto. There is a handle assembly 40 coupled to the front part of the frame 10 for providing a user to support his hands. And at the rearward of the frame 10, there are left and right swing mechanisms 20L/20R coupled thereto for supporting a user to enable him to exercise by stepping the left and right swing mechanisms 20L/20R.

As illustrated in FIG. 1, each of the left and right swing mechanisms 20L/20R comprises a pedal 25 and a substantially longitudinally extending swing arm 21L/21R. In the preferred embodiment of the present invention, each of the swing arms 21L/21R has a pivoting portion 22L/22R in the front part of the swing arms 21L/21R for pivoting to the frame 10 in an outward skew mode. In other words, each angle between relative vertical lines L1 and each of the pivoting portions 22L/22R is an acute angle as shown. Therefore, trajectories of the swing motions of each of the swing arms 21L/21R are arcs sloping in a descending mode from inward to outward which take the respective pivoting portions 22L/22R as the center of the arcs. Each of the swing arms 21L/21R also comprises a supporting portion 23L/23R positioned in the rearward portion to connect to the respective pedals 25. Besides, axial directions L4 of each of the supporting portions 23L/23R and respective axial directions L3 of the pivoting portions 22L/22R are not parallel but have an included angle.

Figure 3:
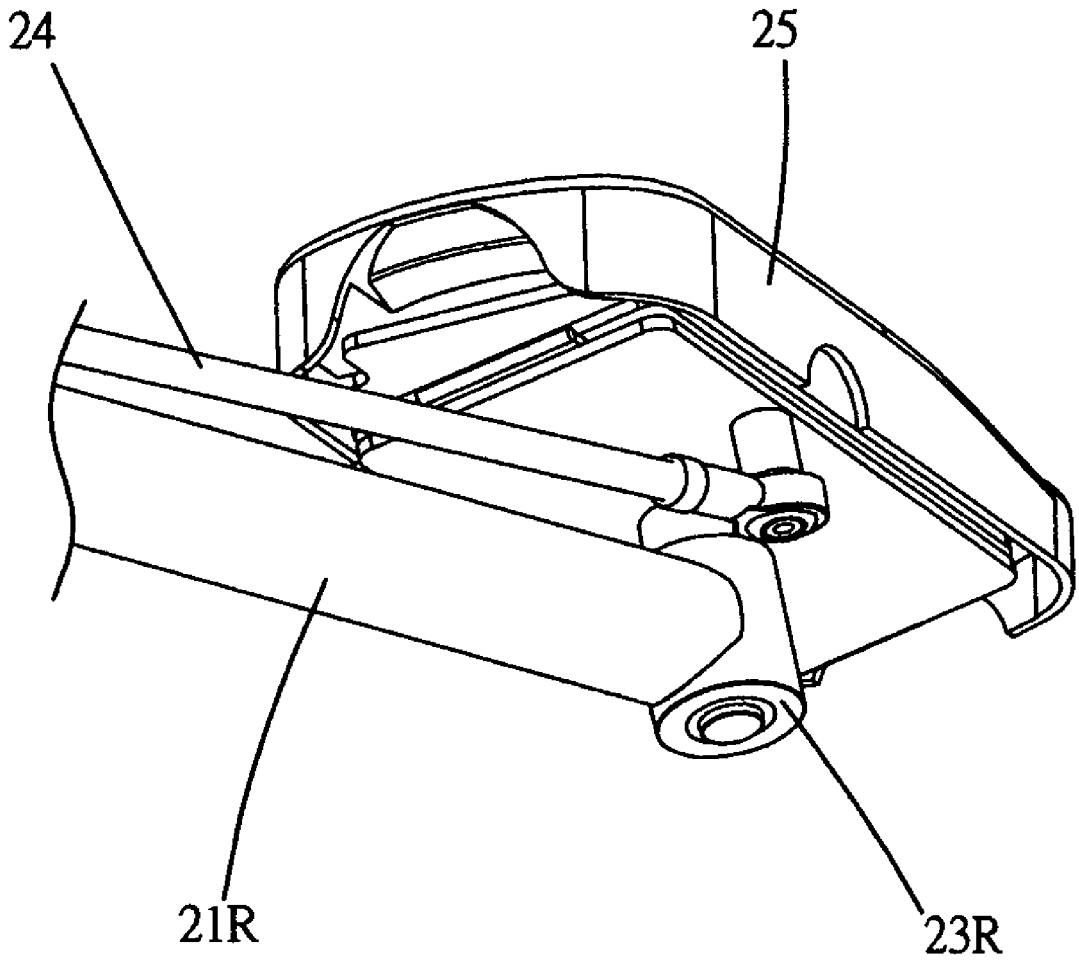
FIG. 3 is a perspective view of the right pedal of the exercise apparatus of FIG. 1.

In this embodiment, each of the left and right swing mechanisms 20L/20R further comprises a control member 24 which substantially extends paralleled to the respective swing arms 21L/21R when the left and right swing mechanisms 20L/20R are at a starting status as FIG. 1. Please referring to FIG. 3, each of the control members 24 is jointed between the frame 10 and the bottom of the respective pedals 25 by a joint. Taking the right swing mechanism 20R for example, the bottom of the right pedal 25, the right swing arm 21R, the right control member 24 and the frame 10 form a shape which is analogous to a four-bar linkage. It can be observed easily that the joint of the right control member 24 is positioned in the front inward part of the right pedal 25 if take the supporting portion 23R of the right swing arm 21R as a datum point to divide the right pedal 25 into four parts. There are several factors can affect the rotation types of the pedals 25. In the preferred embodiment, there are three factors: (a) the position relationship between the joint and the supporting portion 23R, (b) the length of the right control member 24 and right swing arm 21R, and (c) the relative locations to which the right control member 24 and right swing arm 21R are coupled. Above three factors can bring various rotational types of the respective pedals 25 by vector mechanics. The left swing mechanism 20L also has the same structure relationship.

In the preferred embodiment, the right control member 24 can control the front section of the right pedal 25 to rotate progressively toward outside when the right swing arm 21R is swung downward by the structure relationship discussed above. In other words, in a top view of a user while using the exercise apparatus 1, the right pedal 25 will rotate clockwise when he thrust the right swing mechanism 20R outward. And the left pedal 25 will rotate counterclockwise when the left swing mechanism 20L is swung outward. Therefore, when the swing arms 21L/21R are driven to do swing motions as described above, the respective control members 24 are capable to enable the respective pedals 25 to produce rotational movement to optimize the swing motions.

Now referring to FIG. 1 and FIG. 2, there are left and right actuating mechanisms 30 coupled to the forward of the frame 10. And left and right driving members 31 respectively have a first portion 31*a* and a second portion 31*b*. The left and right driving members 31 in the preferred embodiment are levers which are interconnected with respective left and right swing mechanisms 20L/20R by respective first portions 31*a* and respective left and right actuating mechanisms 30 by respective second portions 31*b*.

Each of the left and right actuating mechanisms 30 comprise left and right rotating members 34. In a preferred embodiment, the rotational members 34 are left and right cranks 34 pivoted to the frame 10 defining a crank axis 33.

And the left and right actuating mechanisms 30 further comprises transmission members 35 and two impelled members 36 coupled to the left and right side of the exercise apparatus 1 respectively. In the preferred embodiment of the present invention, two transmission members 35 and two impelled members 36 are levers. However, the left side of the actuating mechanism 30 is not identical to the right side thereof. Please referring to FIG. 1 and FIG. 2, each of the transmission members 35 and the impelled members 36 has a first portion 35*a*/36*a* and a second portion 35*b*/36*b*. Now referring to FIG. 2, the left side of the actuating mechanism 30 as shown, the left impelled member 36 is pivoted to the forward of the frame 10 by a region which is a pivot 36*c* in the preferred embodiment. And the first portion 35*a* of the left transmission member 35 is pivoted to the left crank 34; the second portion 35*b* of the left transmission member 35 is pivoted to the first portion 36*a* of the left impelled member 36. Furthermore, the second portion 31*b* of the left driving member 31 is jointed to the second portion 35*b* of the left transmission member 35 and the first portion 36*a* of the left impelled member 36 coaxially. And the first portion 31*a* of the left driving member 31 is pivoted to the left swing mechanism 20L.

Figure 4:
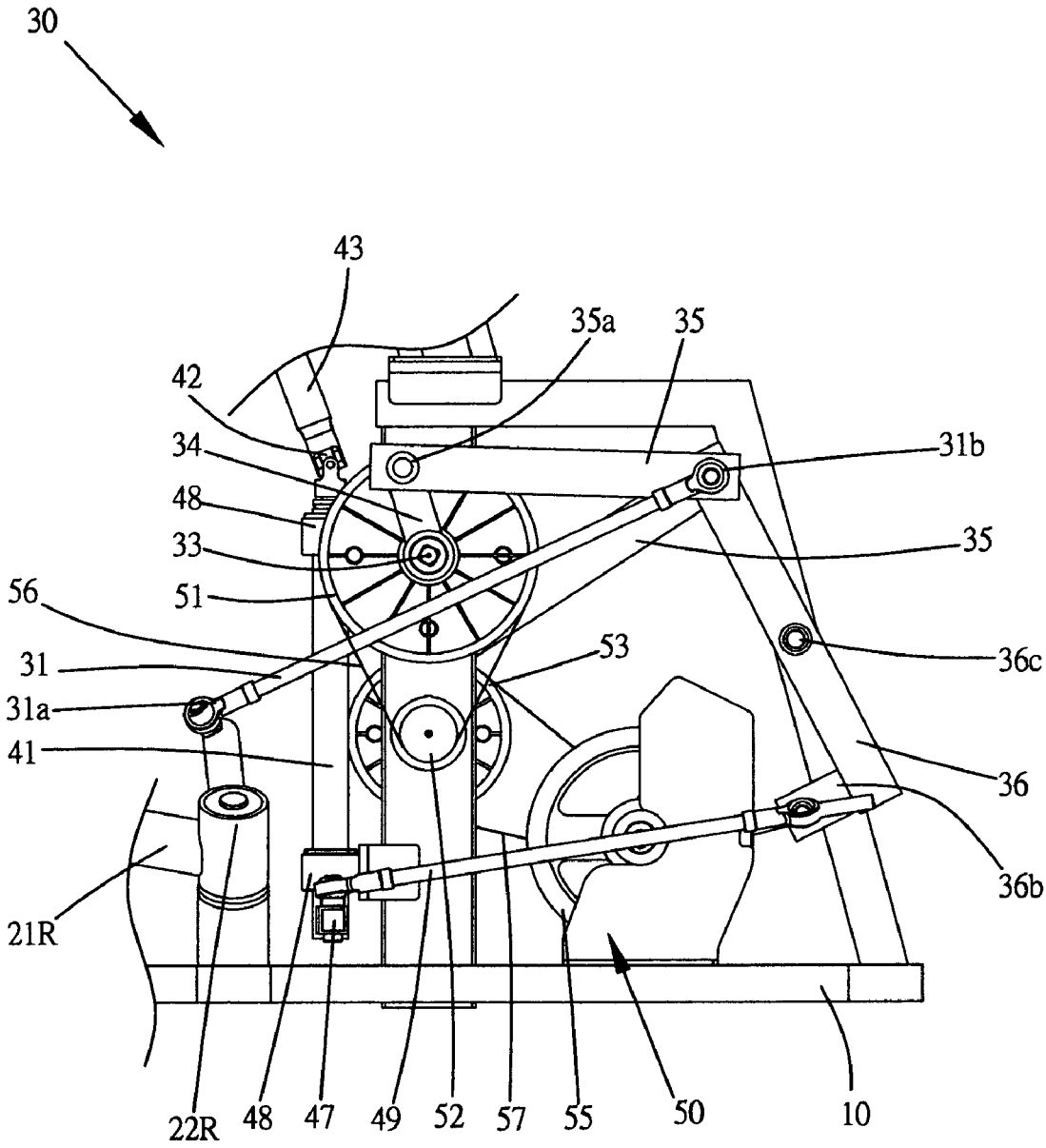
FIG. 4 is a side view of the right actuating mechanism of the exercise apparatus of FIG. 1.

Now looking at FIG. 4 which is the right side elevation view of the actuating mechanism 30, as mentioned earlier, the first portion 35*a* of the right transmission member 35 is pivoted to the right crank 34. And as the left actuating mechanism, the second portion 35*b* of the right transmission member 35 is pivoted to the first portion 36*a* of the right impelled member 36 and the second portion 31*b* of the right driving member 31 coaxially. In the same way, the right impelled member 36 is pivoted to the forward of the frame 10 by a pivot 36*c*. Nevertheless, the second portion 36*b* of the right impelled member 36 further extends downwardly to couple to an auxiliary lever 47 of a rotating shaft 41 of the handle assembly 40 by a mechanical component. In a preferred embodiment, the mechanical component is an elongated bar 49. One end portion of the elongated bar 49 is jointed to the second portion 36*b* of the impelled member 36, and the other end portion of the elongated bar 49 is jointed to auxiliary lever 47.

Therefore, when a user thrust the right swing mechanism 20R outward to pull the right driving member 24 to move rearward, the right driving member 24 also rotates the left and right actuating mechanisms 30 at the same time. And the left crank 34 is rotated to actuate the left driving member 31 to move forward, so that the left swing mechanism 20L is driven to swing inward at the same time. In other word, the left and right swing mechanisms 20L/20R can be thrust to experience two swing motions interactively.

Because of the pivoting portions 22L/22R of each of the left and right swing mechanisms 20L/20R skew outward as discussed before, the swing motions are on two mirroring inclined planes which are both in a descend mode from inside to outside. In view of this, the first portions 31*a* of the left and right driving members 31 are also driven to swing on the respective inclined planes. More specifically, the swing motions are not only reciprocating motions of variation on longitudinal and height directions but also combine with variation in displacement of lateral directions. In other words, the first portions 31*a* of the left and right driving members 31 have a three dimensional exercise during the swing motions. However, the second portions 31*b* of the left and right driving members 31 are constrained by the respective cranks 34 to move on a vertical plane. It may have problems in general situations during the 3D (three dimensions) to 2D (two dimensions) motion transferring on the respective first and second portions 31*a*/31*b* of the left and right driving members 31. In order to make the swing motions more smoothly, the first and second portions 31*a*/31*b* of the left and right driving members 31 are adapted spherical couplings to joint to respective mechanicals.

Figure 5:
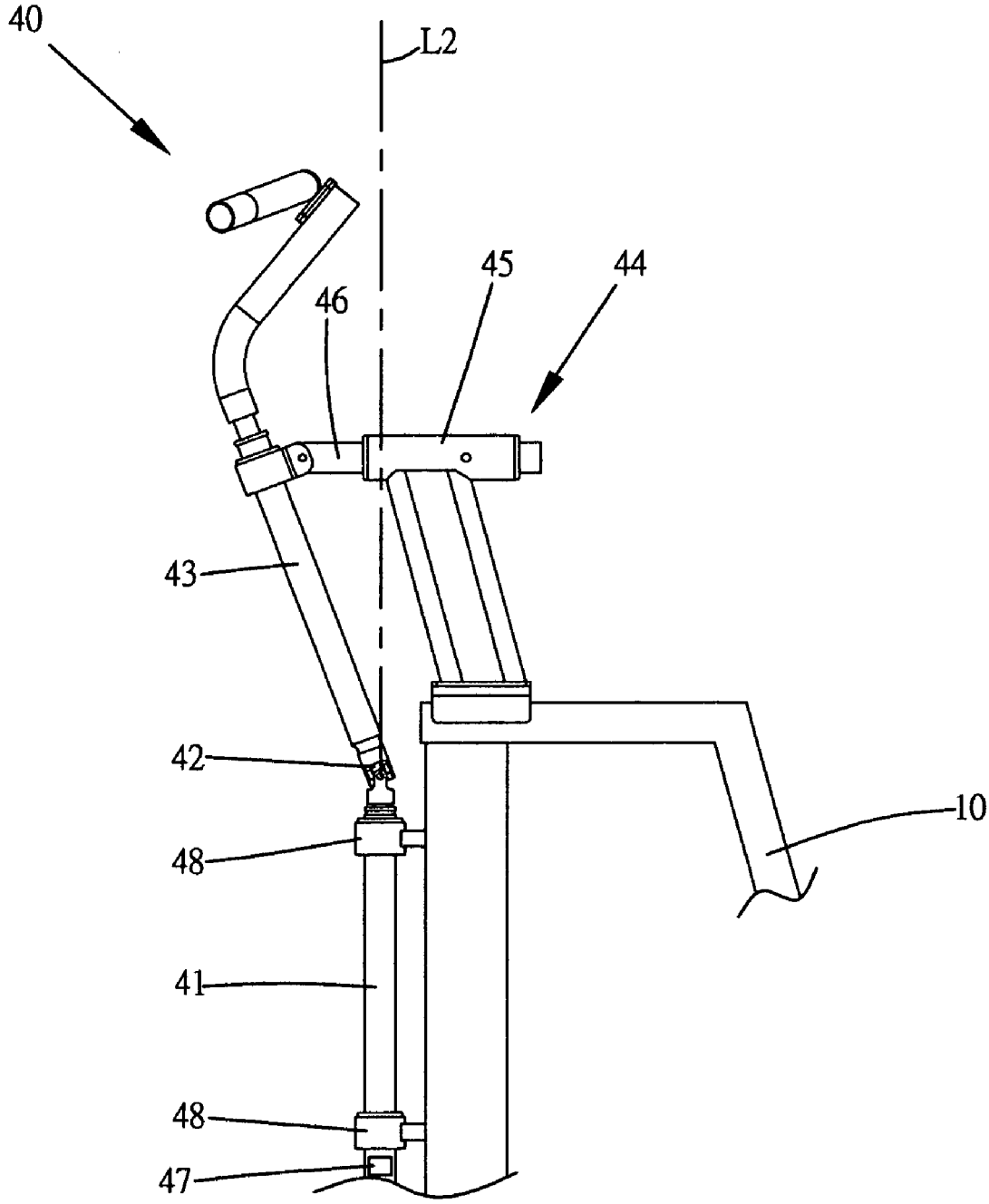
FIG. 5 is a side view of the handle assembly of the exercise apparatus of FIG. 1.

Now please referring to FIG. 1 and FIG. 5, an embodiment of the handle assembly 40 of the exercise apparatus 1 is shown in FIG. 5. The handle assembly 40 substantially comprises a handle member 43, the rotating shaft 41, the auxiliary lever 47 and the elongated bar 49 discussed above. The rotating shaft 41 extends substantial vertically and is coupled to the frame 10 by rings 48 which are located at the top and bottom portion of the rotating shaft 41. Therefore, the rotating shaft 41 can rotate relative to the frame 10. And the auxiliary lever 47 is mounted to the bottom portion of the rotating shaft 41. Consequentially, the rotating shaft 41 can be driven to rotate by the connecting relationship between the auxiliary lever 47 and the elongated bar. A user thrusts the left and right swing mechanisms 20L/20R to force the respective cranks 34 to rotate, then transporting the rotating energy to respective transmission members 35, impelled members 36 and the elongated bar 49. Finally, the rotating energy forces the rotating shaft 41 of the handle assembly 40 to be rotated by the elongated bar 49 and the auxiliary lever 47. It should be understood by people skilled in the art that the way which the rotating shaft 40 is connected to the right actuating mechanism 30 to achieve the same function as described above should have many other solutions and not limit to the preferred embodiment.

As shown in FIG. 5, an adjusting assembly 44 has a sleeve 45 and an adjustable rod 46. The adjusting assembly 44 is mounted to the forward of the frame 10. And the adjustable rod 46 is slidingly attached to the sleeve 45. Also, one portion of the adjustable rod 46 is engaged with the handle member 43. Besides, the handle member 43 is engaged with the rotating shaft 41 by a joint 42 in an inclined angle respective to the vertical line L2. Therefore, a user can change the position of the adjustable bar 46 to rise up or lower down the handle assembly 40 to satisfy his personally exercise habits.

Now referring to FIG. 1 and FIG. 2, the exercise apparatus 1 with a resistance assembly 50 which can be controlled to adjust the rotating resistance of the left and right cranks 34 is mounted to the frame 10. The resistance assembly 50 has a fly wheel 55, first and second belt 56/57, and first to fourth pulleys 51/52/53/54. The first pulley 51 is rigid connected to the crank axis 33 and rotated by the cranks 34. The second pulley 52 and the third pulley 53 are connected to the frame 10 coaxially. The fourth pulley 54 and fly wheel 55 are also connected to the frame 10 coaxially. And then the first belt 56 is wound onto the first pulley 51 and the second pulley 52, similarly, the second belt 57 is wound onto the third pulley 53 and the fourth pulley 54. Besides, the size of each of the pulleys 51/52/53/54 is arranged as shown in FIG. 1 and 2 in order to increase the performance of rotation efficiency of the fly wheel 55.

With the structure of the embodiment described above, it can be imaged the sight of a user stepping on the left and right swing mechanism 20L/20R and gripping his hands on the handle assembly 40. When the user thrusts the right swing mechanism 20R to swing outward to force the right crank 34 starting to be rotated by the right driving member 31, the left crank 34 is also rotated to drive the left transmission member 35 and left driving member 31. Therefore, the left driving member 31 pulls the left swing mechanism 20L to swing inward. As the right crank 34 is started to drive the right transmission member 35 moving rearward, the first portion 36*a* of the right impelled member 36 is also pulled to move rearward. The second portion 36*b* of the right impelled member 36 is moved forward contrarily because the first and second portion 36*a*/36*b* of the impelled member 36 are positioned at opposite sides of the pivot 36*c* as shown in FIG. 4. Therefore, the elongated bar 49 is driven to pull the auxiliary lever 47 to rotate the rotating shaft 41 and the handle member 43 of the handle assembly 40. So the user's body is driven by his hands to have a rotating exercise by the rotation of the handle member 43. That is to achieve the goal of exercising wide range muscles of body.

Figure 6B:
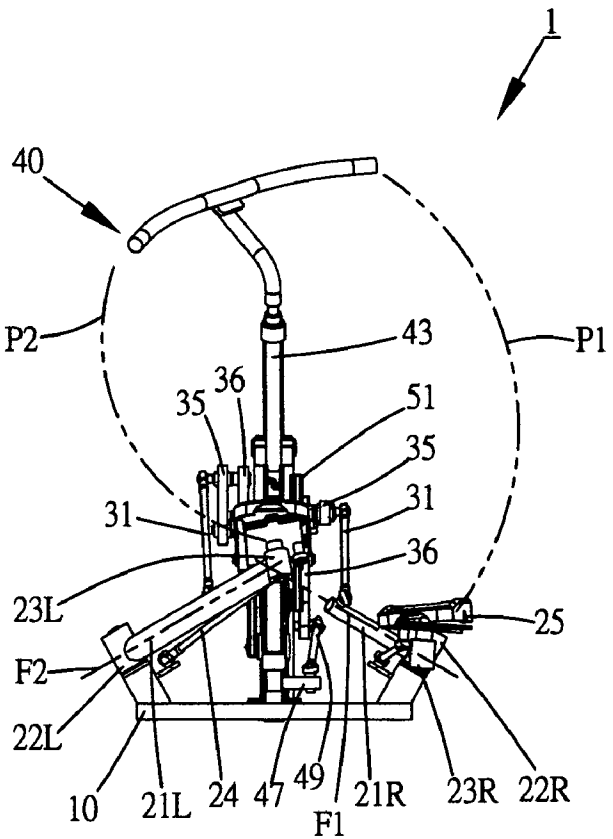
FIGS. 6*a* and 6*b* are illustrated a top view and a back view of the exercise apparatus of FIG. 1 in a rotating position.
Figure 6A:
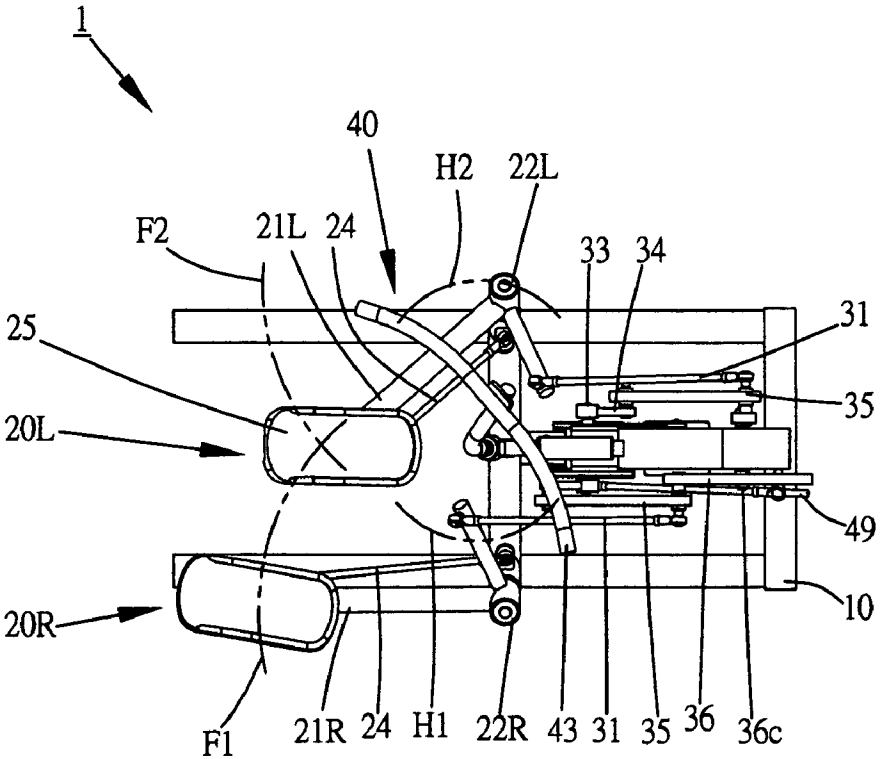

In the exercise process, each of the pedals 25 produces relative rotation movements which are according to the connection relationship between the control members 24 and respective pedals 25 discussed above. As illustrated in FIG. 6*a* and FIG. 6*b*, while the left swing arm 21L is thrust to a position at the most inside point as shown in FIG. 6*a*, the longitudinal direction of the left pedal 25 from the top view is substantially identical to the exercise apparatus. The right swing arm 21R is driven to swing to the most outside point and the right pedals 25 produces obvious lateral rotation. More particularly, the front section of the right pedal 25 rotates more toward outside than its rear section.

Now please referring to FIG. 6*b*, the exercise apparatus 1 as the left pedal 25 at the most inside point, one can obviously observe that the left pedal 25 is in a declined forward mode, and its left and right side sections are substantially at equal height. The declined forward mode is because of the axial direction L4 of the left supporting portion 23L is not parallel to the axial direction L3 of the left pivoting portions 22L of the left swing arms 21L. When the left swing arm 21L swings to the most inside point as shown in FIG. 6*b*, the included angle between the two axial directions L3/L4 leads the left pedal 25 to decline forward. Referring to the right pedal 25 which is at the most outside point, the included angle of the two axial directions L3/L4 leads the inside section of the right pedal 25 lower than the outside section thereof. Also, the declined forward mode of the right pedal 25 rotates to a substantially horizontal status.

Figure 8A:
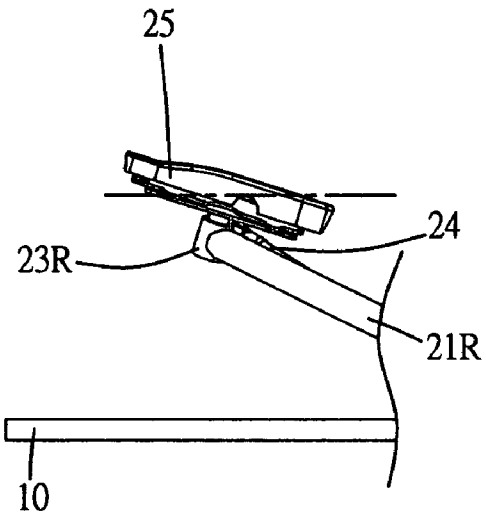
* and FIGS. 8*a*, 8*b* and 8*c* are illustrated a side view of the right pedal of the exercise apparatus of FIG. 1 in three positions.
Figure 8B:
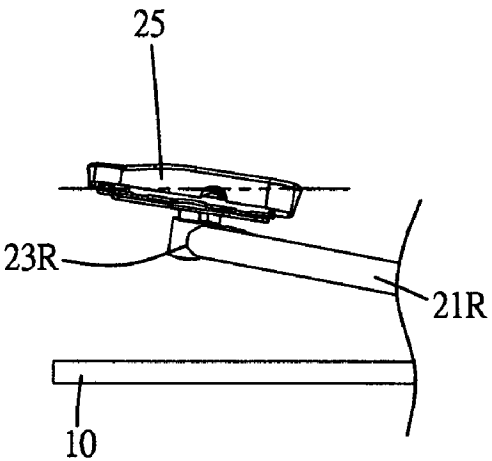
Figure 8C:
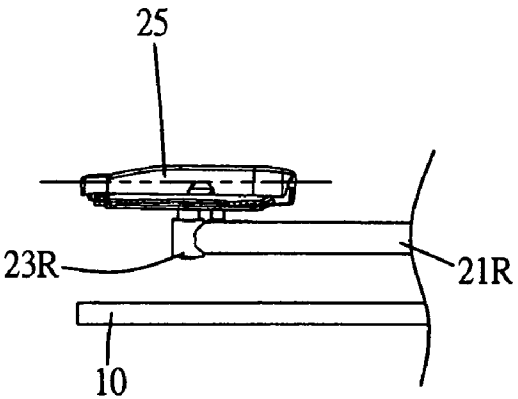

In summary of described above, please refer to the FIG. 8 which is the right pedal 25 at three positions separately corresponding to the most inside point, starting point, and the most outside point. When the right pedal 25 at a starting point as FIG. 8*b* moves to the status as FIG. 8*a* through a swing motion, the declined forward angle of the right pedal 25 increases. This is due to the progressive upward swing motion of the right swing arm 21R which directly affects the included angle of axial L3 and L4. As the swing motion moving to the most outside point, the declined angle progressively changes toward substantial horizontal. Referring to FIG. 6*a* and FIG. 6*b*, as the right pedal 25 at the most outside point, the inside section of the right pedal 25 rotates downward and the outside section of the right pedal 25 rises up. In other words, the right pedal 25 is progressively doing an inclined inward during the outward swing motion. And during the right swing mechanism 20R swings outward, the right pedal 25 also rotates outward at its front section. The rotation movement of the left pedal 25 is the same as the right pedal 25.

The rotation movements of the pedals 25 make a user more comfortable as doing exercise. Because of the rotation movements, the pedals 25 can match the user's feet more closely while doing exercise. Besides, the pedals 25 maintain the declined forward mode until they swing to the respective most outside point where the pedals 25 are substantial horizontal. The declined forward mode of the pedals 25 makes a user more easily to thrust the left and right swing mechanisms 20L/20R and enables the preferred embodiment more user-friendly.

Combining the characteristics of the pedals inclining inward, rotating outward at front sections of the pedals 25 with the pivoting portions 22L/22R pivoted to the frame 10 in the outward skew mode. So the compound trajectories of the pedals 25 and the swing arms 21L/21R are summed up for simulating the speed skating but not limited to. While a player doing speed skating, his legs slide back and outward to thrust his body to move forward. At this status, the user's feet at the most outward point are rotating outside. These are substantially same as the representation of the pedals 25 at the most outside points in the embodiment. Therefore, the compound trajectories of the preferred embodiment are more conformed to the kinesiology.

Now referring to FIG. 1 and FIG. 6, as the right swing mechanism 20R swings toward outward, the right pivoting portion 22R rotates counterclockwise. At the same time, the left pivoting portion 22L also rotates counterclockwise as the left swing mechanism 20L swings toward inside. Furthermore, the right driving member 31 is pulled-rearward by the right swing mechanism 20R and simultaneously driven the second portion 36*b* of the right impelled member 36 moving forward. The right impelled member 36 pulls the elongated bar 49 and the auxiliary lever 47 to move forward. Finally, the rotating shaft 41 of the handle assembly 40 is rotated counterclockwise synchronously by the auxiliary lever 47.

Therefore, the pivoting portions 22L/22R of the left and right swing mechanisms 20L/20R and the rotating shaft 41 of the handle assembly 40 rotate at a same direction as a user doing exercise. In other words, a user's right hand and right foot will mutually come closely or go far away, and the left hand and left foot in common with the right hand and right foot. That makes a user can huddle up or extend his body to make the reciprocating exercise path of hands and foot become longer. Therefore, enhances the intensity of the user's body exercise.

Figure 7B:
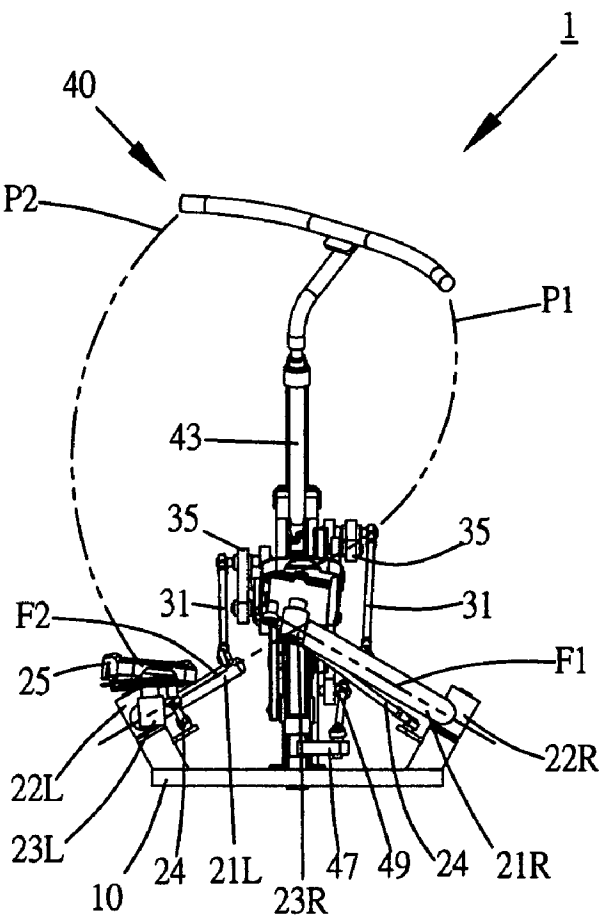
FIGS. 7*a* and 7*b* are illustrated a top view and a back view of the exercise apparatus of FIG. 1 in another rotating position relative to FIGS. 6*a* and 6*b.
Figure 7A:
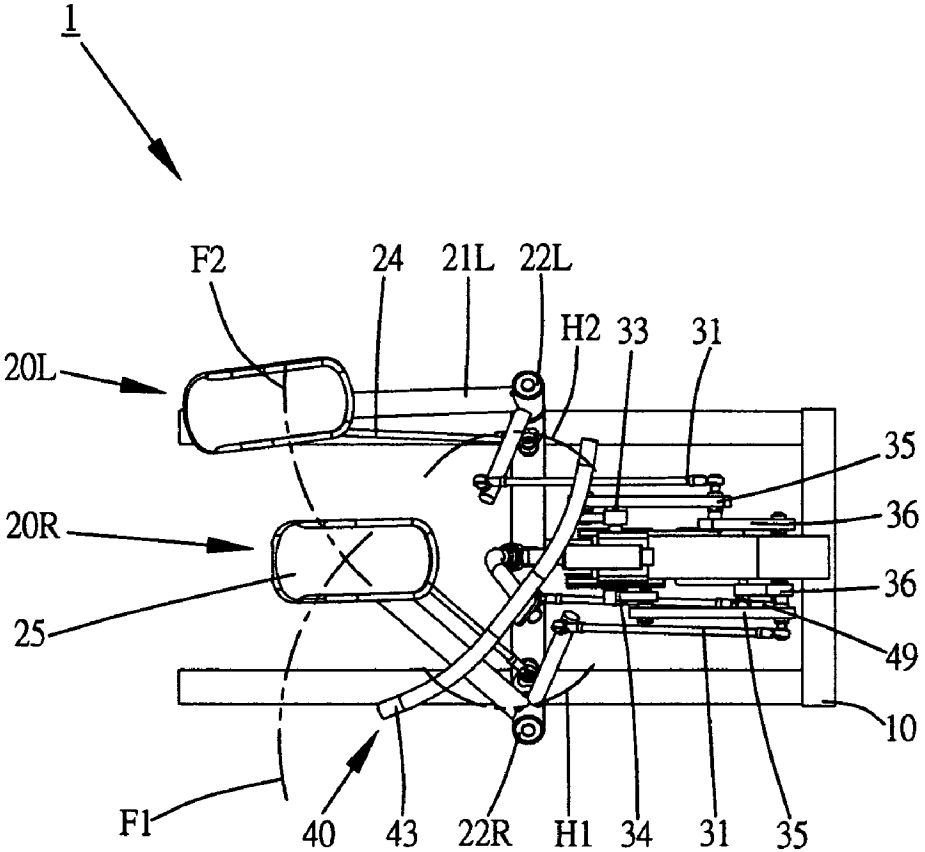

FIG. 6*a* shows the trajectories F1 and F2 of the left and right swing mechanisms 20L/20R and the rotating paths H1 and H2 of the handle assembly 40. It can be obviously observed from FIG. 6*a*, the distance between the right swing mechanism 20R and the right side of the handle assembly 40 is longer than the left swing mechanism 20L and the left side of the handle assembly 40. FIG. 7*a* is the exercise apparatus 1 in another rotating direction status.

Besides, the exercise apparatus 1 of the preferred embodiment has many characteristics. Specifically, (a) "a user can huddle up or extend his body to make the reciprocating exercise more longer" as discussed above, (b) the handle member 40 is engaged with the rotating shaft 41 in an inclined angle by the joint 42, and (c) the outward skewed mode of the pivoting portions 22L/22R of the left and right swing mechanisms 20L/20R result in the descending trajectories F1 and F2. In summary of these characteristics, the status of the swing motion is in a variation in lateral, longitudinal and vertical displacements. This kind of motion can make muscles of legs to be trained more integrity.

As discussed above, when the right swing mechanism 20R swings to the most outside and lowest point, the right side of the handle assembly 40 not only rotates counterclockwise but also rotates upwardly to the highest point of the rotating path H1. So that, a user's right hand is at the relative left-front and highest point and right foot is at the relative right-back and lowest point. The right hand and right foot are at two different longitudinal planes and perform a kind of oblique extending. Meanwhile, the left hand accompanies with the handle member 43 rotating counterclockwise to the lowest point of H2. The left foot accompanies with left swing mechanism 20L swinging to the most inside and highest point. As the exercise status of the right hand and right foot, the left hand and the left foot are also at two different longitudinal planes, but perform another oblique extending which the left foot is more inside than the left hand. Therefore, the core of the user's body is driven to huddle up or extend by the characteristic of "the left and right swing mechanisms 20L/20R and the rotating shaft 41 of the handle assembly 40 rotate at a same direction".

P1 and P2 separately simulate the huddling up and extending paths of the user's left and right side body. The user's waist is also driven to rotate counterclockwise by limbs in FIGS. 6*a* and 6*b*. In view of this, the preferred embodiment can make a user's body experiencing huddling up, extending, and rotation exercise that various exercise types further enhance the training intensity.

Alternatives of performing the same function of "rotating at a same direction" of the preferred embodiment should be noted by people skilled in the art. In the preferred embodiment, the second portion 31*b* of each of the driving members 31 is pivoted to the respective second portions 35*b* of each of the transmission members 35 coaxially to achieve the function of moving at a same direction. Essentially, one may achieve the same characteristics of the preferred embodiment by ensuring the moving direction of the second portion 31*b* of the right driving member 31 being opposite to the second portion 36*b* of the right impelled member 36. In other words, one may have the same characteristics of discussed above, only to connect the second portion 31*b* of the right driving member 31 to the place of the right actuating mechanism 30 which is upper than the pivot 36*c* of the right impelled member 36. It should be recognized as easily to understand by people skilled in the art, so didn't show other possible embodiments in the relative figures.

The goal of this invention is to make a user to have a wide range of exercise. The preferred embodiment does not require that all the advantageous features and all the advantages described need to be incorporated into every embodiment thereof. Although the present invention has been described in considerable detail with reference to certain preferred embodiments thereof, other embodiments are possible. Therefore, the spirit and scope of the appended claims should not be limited to the description of the preferred embodiment contained herein.

The invention claimed is:

1. An exercise apparatus, comprising:

(a) a frame;

(b) a swing mechanism comprising a swing arm and a pedal, the swing arm having a pivoting portion pivotally connected to the frame and a supporting portion to engage with the pedal;

(c) a handle assembly having a handle member and a rotating shaft, the rotating shaft coupled to the frame and engaged with the handle member;

(d) an actuating mechanism coupled to the frame, the actuating mechanism having a transmission member, an impelled member pivotally connected to the frame and a rotating member rotatably coupled to the frame, bath the transmission member and the impelled member having a fast portion and a second portion, the first portion of the transmission member coupled to the rotating member and the second portion of the transmission member coupled to the first portion of the impelled member, the second portion of the impelled member coupled to the rotating shaft of the handle assembly wherein the moving direction of the second portion of the transmission member is opposite to the second portion of the impelled member; and (e) a driving member having a first portion joined to the swing mechanism and a second portion joined to the actuating mechanism wherein the moving direction of the second portion of the driving member is the same with the first portion of the impelled member;

whereby the pivoting portion of the swing mechanism and the rotating shaft of the handle assembly rotate at a same direction when the actuating mechanism is driven by the driving member.

2. The exercise apparatus of claim 1, wherein the pivoting portion of the swing mechanism is positioned in the front outward of the pedal of the swing mechanisms.

3. The exercise apparatus of claim 1, wherein the pivoting portion of the swing mechanism is pivoted to the frame at an acute angle with respect to the ground.

4. The exercise apparatus of claim 1, the swing mechanism further comprising a control member interconnected with the pedal of the swing mechanism and the frame.

5. The exercise apparatus of claim 4, wherein the control member can control the pedal to decline forward when the pedal is positioned at relative inside position.

6. The exercise apparatus of claim 4, wherein the control member can control the front section of the pedal rotating outward when the pedal is positioned at relative outside position.

7. The exercise apparatus of claim 1, wherein the handle assembly is connected to the frame at an acute angle with respect to the frame.

8. The exercise apparatus of claim 1, wherein the impelled member is connected to the frame by a region positioned between the first and second portion of the impelled members.

9. The exercise apparatus of claim 8, the handle assembly further comprising an elongated bar jointed between the rotating shaft of the handle assembly and the second portion of the impelled member.

10. An exercise apparatus, comprising:

(a) a frame;

(b) left and right rotating members rotatably coupled to the frame to rotate simultaneously;

(c) left and right swing mechanisms, each of the left and right swing mechanisms comprising a pedal and a swing arm, each of the swing arms having a supporting portion to engage with the pedal and a pivoting portion pivotally connected to the frame;

(d) left and right driving members, each of the left and right driving members having a first portion jointed to the respective left and right swing mechanisms and a second portion joined to the corresponding rotating member;

(e) left and right impelled members, each of the left and right impelled members respectively pivotally connected to the left and right sides of the frame;

(f) left and right transmission members respectively pivotally interconnected to the left and right impelled members and the left and right rotating members;

(g) a handle assembly having a handle member, a rotating shaft interconnected to the frame and the handle member, wherein the handle assembly is coupled to one of the left and right impelled members.

11. The exercise apparatus of claim 10, the handle assembly further comprising an elongated bar interconnected between the rotating shaft of the handle assembly and the impelled member.

* * * * *